US007677571B2

(12) United States Patent
Adams, III

(10) Patent No.: US 7,677,571 B2
(45) Date of Patent: Mar. 16, 2010

(54) GAME APPARATUS

(76) Inventor: Bobbie Lee Adams, III, 251 Laurel Hill Ave., Norwich, CT (US) 06360

( * ) Notice: Subject to any disclaimer, the term of this patent is extended or adjusted under 35 U.S.C. 154(b) by 0 days.

(21) Appl. No.: 11/255,671

(22) Filed: Oct. 21, 2005

(65) Prior Publication Data

US 2006/0038343 A1 Feb. 23, 2006

Related U.S. Application Data

(63) Continuation of application No. 10/641,346, filed on Aug. 14, 2003, now abandoned.

(51) Int. Cl.
*A63F 5/04* (2006.01)

(52) U.S. Cl. ..... 273/274; 273/142 JA; 273/142 R; 273/292; 273/142 J

(58) Field of Classification Search ..... 273/274, 273/292, 142 R, 143 C–143 E, 142 A–142 H, 273/142 J, 142 JA–142 JD; 463/16, 17, 22
See application file for complete search history.

(56) References Cited

U.S. PATENT DOCUMENTS 1,670,692 A 5/1928 Rosar
1,892,664 A 1/1933 Eyles
3,941,389 A 3/1976 Guimond
4,149,728 A * 4/1979 Thompson ..... 273/274
4,492,378 A * 1/1985 Williams ..... 273/142 HA
5,184,821 A * 2/1993 Korenek ..... 273/138.2
5,188,363 A 2/1993 Marnell, II et al.
2005/0167912 A1 * 8/2005 Sokolov ..... 273/142 R

* cited by examiner

*Primary Examiner*—Benjamin H Layno
(74) *Attorney, Agent, or Firm*—Mark E. Pochal

(57) ABSTRACT

A game apparatus is disclosed. The game apparatus comprises a rotatable wheel having a display surface divided into fifty-four concentric areas including indicia of fifty-two standard playing cards and indicia of two joker playing cars with stopping pegs disposed between each of the indicia of fifty-two standard playing cars and the indicia of two joker playing cards. The rotatable wheel is rotatably mountable to a stationary wheel having at least three tangs. the game apparatus also comprises a horizontal playing surface used in conjunction with the rotatable wheel. The horizontal playing surface has a main playing area divided into six columns of nine plots including indicia of fifty-two playing cards and indicia of two joker playing cards and a plurality of vetting areas disposed on at least three borders of the main playing area.

10 Claims, 11 Drawing Sheets

GAME APPARATUS

PRIORITY STATEMENT

This application claims priority to and is a continuation of application Ser. No. 10/641,346 entitled one card poker with the joker poker wheel and filed on Aug. 14, 2003

BACKGROUND

The present invention relates to a game apparatus and n=more particularly to a game apparatus that utilizes playing card symbols with a rotating wheel the use of a rotating wheel to play casino type games (i.e. roulette) is known in the art, as illustrated in U.S. Pat. No. 1,670,692 to Rosar, U.S. Pat. No. 1,892,664 to Eyles, U.S. Pat. No. 3,941,389 to Guimond, and U.S. Pat. No. 5,188,363 to Marnell, 11 et al. however none of these games combine the use of a rotating wheel with a stationary table to play poker using card indicia using this unique concept.

U.S. Pat. No. 4,492,378 to Williams ("the 378 Patent") discloses a game apparatus that utilizes a rotatable wheel in combination with a playing table. Both the table and wheel include indicia form the standard fifty-two card playing deck. A single rotatable wheel has fifty-two segments representing the fifty-two card of the standard playing card deck. the game combines' the rotatable wheel with a horizontal play surface, which includes fifty-two spaces arranged in rows according to suit and columns according to denomination. Although the '378 patent discloses a rotating wheel that can be used in combination with a horizontal playing surface, the arrangement of the card indicia on the wheel and the stationary wheel, and the method of playing the game is too complex to understand for even the skilled poker player. The concept used herein as explained in the claims is what is needed.

What is needed in the art is a game apparatus, which utilizes playing card indicia, a rotating wheel, a horizontal game board, and elements of the card game poker that is easy to understand and play.

SUMMARY

The disclosure is directed toward a game apparatus the game comprises a rotatable wheel having a display surface divided into fifty four concentric areas including indicia of fifty-two standard playing cards and indicia of two joker playing cards with stopping pegs disposed between each of the indicia of fifty-two standard playing cards and the indicia of two joker playing cards. The rotatable wheel is mountable to a stationary wheel having at least three tangs. The game apparatus also comprises a horizontal playing surface used in conjunction with the rotatable wheel. The horizontal playing surface has a main playing area divided into six columns of nine plots including indicia of fifty-two standard playing cards and indicia of two joker playing cards and a plurality of betting areas disposed on at least three borders of the main playing area.

The disclosure also discloses that the indicia of the standard playing cards are represented by two, three, four, five, six, seven, eight, nine, ten, jack, queen, king and ace each in a suit of hearts, spades diamonds and clubs.

The disclosure also discloses that the stationary wheel is mounted to a vertical support and rotatable wheel is mounted on an axle attached to the stationary wheel. The disclosure also discloses that the stopping pegs physically interact with the at least three tangs to stop a rotating of the rotatable wheel.

The disclosure also discloses that the indicia of fifty-two standard playing cards and the indicia of two joker playing cards are positioned on the rotatable wheel in an order including A-D, 6-S, 5-H, 7-S, K-D, Q-C, J-H, 10-C, 9-S, 8-S, 7-H, 6-C, 5-D, 4-S, O-D, 2-C, J-D, 9-S, Lil joker, 8-H, J-C, A-H, 5-C, 7-D, 4-C, 8-D, K-S, 10-D, A-S, 3-D, Q-S, 6-H, 9-C, 2-H, K-C, 4-D, 8-C, 2-D, 10-S, Q-H, 3-CBig joker, K-H, 2-5, 4-H, 5-S, 10-H, 3-S, 6-D, A-C, 3-H, 7-C, 9-H, J-S, which results in the following order of placement of card corresponding to the three tangs.

Placement of all Cards

Same as Original Wheel

| Suit Dealer's Card Up-Top Card Bottom Card Won Lost | | | | | |
|---|---|---|---|---|---|
| | Diamonds | A | 4S | Big Jack | U D |
| | Spades | 6 | QD | KH | UID |
| LINE 3 | Hearts | 5 | 2C | 2S | UID Pay Pair |
| | Spades | 7 | JD | 4h | D U |
| | Diamonds | K | 9s | 5s | UID |
| | Clubs | Q | LilJoker | 10h | D U |
| | Hearts | J | 8h | 3s | UID |
| | Clubs | 10 | Jc | 6d | D U |
| Line9 | Diamonds | 9 | Ah | Ac | UID |
| | Spades | 8 | 5c | 3h | UID |
| Line11 | Hearts | 7 | 7d | 7c | Trip Win/Any Pair Win |
| | Clubs | 6 | 4c | 9h | UD |
| | | D5 | 8d | js | UID |
| | | S4 | Ks | Ad | UID |
| | | DQ | 10d | 6s | UID |
| | | C2 | As | 5h | UID |
| | | DJ | 3d | 7s | UID |
| | | | S9 | Qs Kd | UID |
| | | Lil joker | 6h | Qc | UID |
| | | D4 | 6d | 5c | UID |
| | | C8 | Ac | 7d | D U |
| | | D2 | 3h | 4c | UID |
| | | S10 | 7c | 8d | UID |
| | | HQ | 9h | Ks | U D |
| | | C3 | Js | 10d | UID |
| Line 42 | | Big Joker | Ad | As | UID Pay High Pair Any Pair |
| | | HK | 6s | 3d | UID |
| | | S2 | 5h | Qs | UID |
| | | H4 | 7s | 6h | UID |
| | | s5 | Kd | 9c | UID |
| | | H10 | Qc | 2h | D U |
| | | S3 | Jh | Kc | UID |
| | | D6 | 10c | 4d | D U |
| | | CA | 9d | 8c | UID |
| | | H3 | 8s | 2d | D U |
| | | C7 | 7h | 10s | stay D middle any |
| | | H9 | 6c | Qh | U D |
| | | sJ | 5d | 3c | UID |
| | | H8 | 9c | Jh | UID |
| | | CJ | 2h | 10c | UID |
| | | HA | Kc | 9d | UID |
| | | C5 | 4d | 8s | U D |
| | | D7 | 8c | 7h | Pay Top11pair Pay any pair Pay pair sevens Bottom Bet Stay |
| | | C4 | 2d | 6c | U D |
| | | SK | Qh | 4s | UID |
| | | D10 | 3c | QD | UD |
| | | D8 | 10s | 5d | UID |
| | | SA | Big Joker | 2c | D U |
| | | D3 | Kh | JD | UID |

-continued

| Suit Dealer's Card Up-Top Card Bottom Card Won Lost | | | |
|---|---|---|---|
| SQ | 2s | 9s | UID |
| H6 | 4h | Lil Joker | U D |
| C9 | 5s | 8h | UID |
| H2 | 10h | Jc | UID |
| CK | 3s | Ah | U D |

Ups Won 26 Lost 26

Down Won 26 Lost 26

Deuces come out once, dealer 5 hearts

Aces come out twice, dealer 9d/Big Joker

Trips come out once; dealer pays 777, pair, 7d

Sevens come out twice, dealer pays up, pays down

Because of all the (78) bets, the dealer has an advantage.

The dealer card will win 26 times against the top card and 26 times against the bottom card; it will also lose times against either.

| Suit Dealer's Card Up-Top Card Bottom Card | | |
|---|---|---|
| Won | | Lost |
| For dealer | | for dealer |
| Diamonds | A 4s | Big Joker U D |

Means suit of dealer's ace is Diamonds, the top card is

The four of spades, which the dealer beat.

The down card is the Big Joker, which beat the Dealers ace, and the win/lost tally shows such.

The wheel is mathematically placed so that win/lost Are about equal, but when such happens it's very mixed up.

The disclosure also discloses that the game apparatus is configured to be a single apparatus and the game apparatus is configured to be an electronic apparatus.

The disclosure is also directed to a method of playing a game apparatus. The method comprises placing a betting piece on a horizontal playing surface to make a bet. The horizontal playing surface comprises a main playing area divided into six columns of nine plots including fifty-two standard playing cards and two joker playing cards and a plurality of betting areas disposed on at least three borders of the main playing area. The method also comprises spinning a rotatable wheel about an axle disposed in a stationary wheel having at least three tangs. The rotatable wheel has a display surface divided in fifty four concentric areas including indicia of fifty-two standard playing cards and two joker playing cards corresponding to the indicia of fifty-two standard playing cards and the indicia of the two joker playing cards of the game board. The rotatable wheel has stopping pegs disposed between each of the playing card indicia, the method comprises noting a position of each of the at least three tangs when rotational motion of the rotatable wheel is stopped by the at least three tags and the stopping pegs. Lastly, the method comprises determining a winner of the bet.

BRIEF DESCRIPTION OF FIGURES

Referring now to the figures wherein like elements are numbered alike.

DETAILED DESCRIPTION

Persons of ordinary skill in the art will realize that the following disclosure is illustrative only and not in any way limiting. Other embodiments of the invention will readily suggest themselves to such skilled persons having the benefit of this disclosure.

The present invention is a game apparatus that can be used to play poker. However, no physical playing cards are dealt to the players. The game apparatus utilizes a rotatable wheel and a horizontal playing surface (or game board) to play poker. The players make bets on the game board and the dealer spins the rotatable wheel. The rotatable wheel has three stopping positions (or tangs) that are utilized to determine the winner of the bets. The various games can be played against the dealer (as in regular poker) or as a roulette type game (a game of chance). Many variations of bets can be placed on the game board utilizing each individual stopping position or a combination of two or all of the stopping positions.

Figure 1:
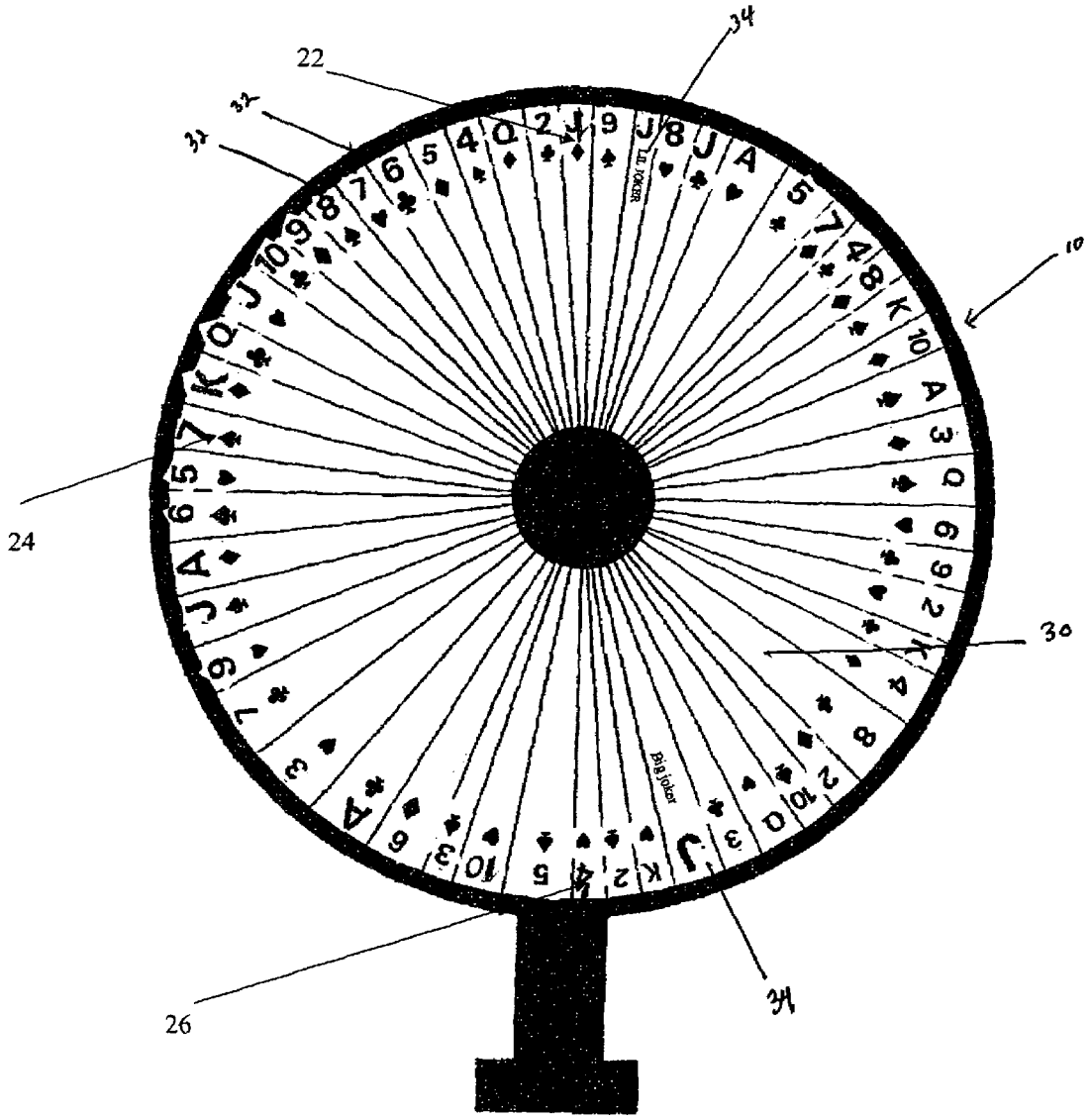
FIG. 1 is a perspective view of an exemplary embodiment of the rotatable wheel surrounded by the stationary wheel.
Figure 2:
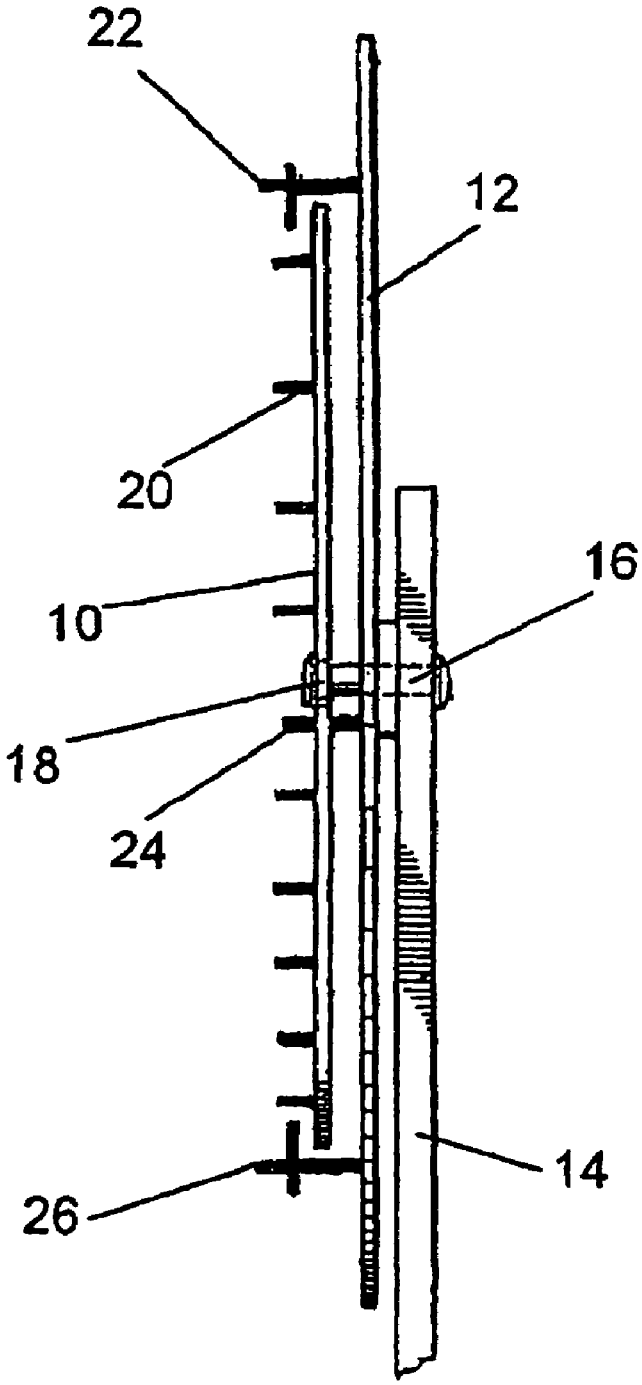
FIG. 2 is a side view of the rotatable wheel and the stationary wheel of FIG. 1 illustrated the mounting arrangement.

Referring to FIGS. 1 and 2, a rotatable wheel 10 is connected to a stationary back wheel 12. As is seen in FIG. 2, the rotatable wheel 10 and the stationary back wheel 12 are mounted on a vertical support 14. Concentric with an axle 16, the rotatable wheel 10 has low-friction bearings 18, which enable it to spin freely on the axle 16 while the stationary back wheel 12 is rigidly secured to the vertical support 14. A plurality of stopping pegs 20 in the form of rods, pins, and the like, project frontward from the rotatable wheel 10 and intersect a plurality of flexible stopping positions (or tangs) (three tangs 22, 24, 26 are illustrated in FIG. 1), which eventually stops rotation of the rotatable wheel 10 when rotational inertia of the rotatable wheel 0 is insufficient to bend the tangs 22, 24, 26 so as to clear the stopping pegs 20. The three tangs 22, 24, 26 can be positioned as described in relation to a conventional clock to be at about 12 o'clock, about 9 o'clock and about 6 o'clock, respectively. Accordingly, when a person rotates the rotatable wheel 10 manually, the rotational position of the rotatable wheel 10 with respect to the stationary wheel 12 when the rotatable wheel 10 stops is determined only by chance. When utilizing this apparatus to play the game in which the angular position of the rotatable wheel 10 determines the outcome of the game, players rely on guesses which are registered on the game board 28 of FIG. 3.

Referring again to FIG. 1, an exemplary rotatable wheel 10 is illustrated. The rotatable wheel 10 is divided by radii into fifty-four sectors 30. Within each of the fifty-four sectors 30 are indicia of a standard playing deck of cards (i.e., fifty-two cards) 32 and two joker playing card indicia 34 for a total of fifty-four playing card indicia. The standard playing card indicia 32 include "two (2)", "three (3)", "four (4)", "five (5)", "six (6)", "seven (7)", "eight (8)", "nine (9)", "ten (10)", "jack (J)", "queen (Q)", "king (K)" and "ace (A)" in the four suits of hearts (♥), spades (♠), diamonds (♦), and clubs (♣). The division of the rotatable wheel 10 into triangular areas 30 is only for the purposes of illustration, any configuration which includes fifty-four areas represented by the standard deck of playing cards and two joker playing cards is Contemplated.

The positioning of the standard playing card indicia 32 and the joker playing card indicia 34 on the rotatable wheel 10 is purposefully derived. The order of the standard playing card indicia 32 and the joker playing card indicia 34 on the rotatable wheel 10 allows for an equal number of losses and wins between the player and the dealer. The standard playing card Indicia 32 and the joker playing card indicia 34 are disposed on the rotatable wheel 10 in the following order A-D, 6-S, 5-H, 7-S, K-D, Q-C, J-H, 10-C, 9-S, 8-S, 7-H, 6-C, 5-D, 4-S, O-D, 2-C, J-D, 9-S, Lil joker, 8-H, J-C, A-H, 5-C, 7-D, 4-C, 8-D, K-S, 10-D, A-S, 3-D, Q-S, 6-H, 9-C, 2-H, K-C, 4-D, 8-C, 2-D, 10-S, Q-H, 3-C, Big joker, K-H, 2-5,4-H, 5-S, 10-H, 3-S, 6-D, A-C, 3-H, 7-C, 9-H, J-S, Referring now to FIG. 3 the horizontal game surface (or game board) 28 is illustrated. The game board 28 includes a main playing area 40 having indicia of a standard playing deck of cards (i.e., fifty-two cards) 36 and two joker playing card indicia 38 for a total of fifty-four cards disposed in six columns (or lines) of nine playing cards, the standard deck of cards, the standard deck of cards indicia 336 include two three four, five n six, seven, eight, nine, ten, jack, queen, king and ace, in the four suits of hearts, spades, diamonds, and clubs. the positioning of the standard playing card indicia 36 and the joker playing card indicia 38 on the game board 28 can correspond to the order presented above, or can be randomly arranged, Additionally, the game board 28 has other betting positions 42 disposed on either side of the main playing areas 40. These betting positions 42 can be grouped onto three distinct areas, card bets 44, 44*a*, 44*b*, 44*c*, 44*d*, 44*e*, 44*f*, 44*g*, columns bets 46, 46*a*, 46*b*, 46*c*, 46*d* 46*e*,46*f*, 46*g*,46*h*, 46*i*,46*j*, 46*k*, and row and descriptive 48, 48*a*, 48*b*,48*c*,48*d*,48*e*,48*f*,48*g*,48*h*, 48*i*, 48*j*,48*k*,48*l*. The betting positions 42 are described further herein and illustrated in part on FIG. 3.

Figure 3:
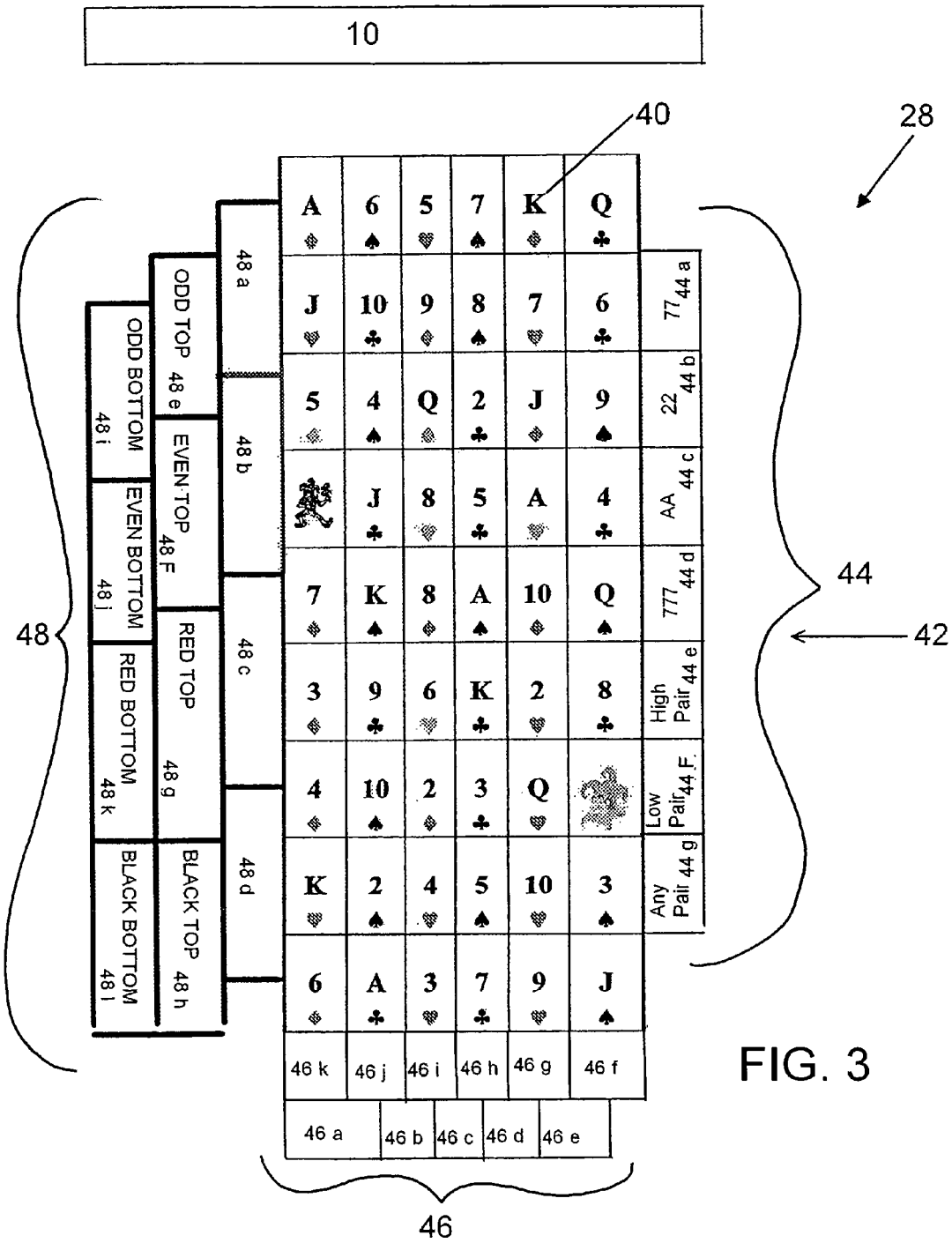
FIG. 3 is a perspective view of an exemplary embodiment of the horizontal game table surface.
Figure 4:
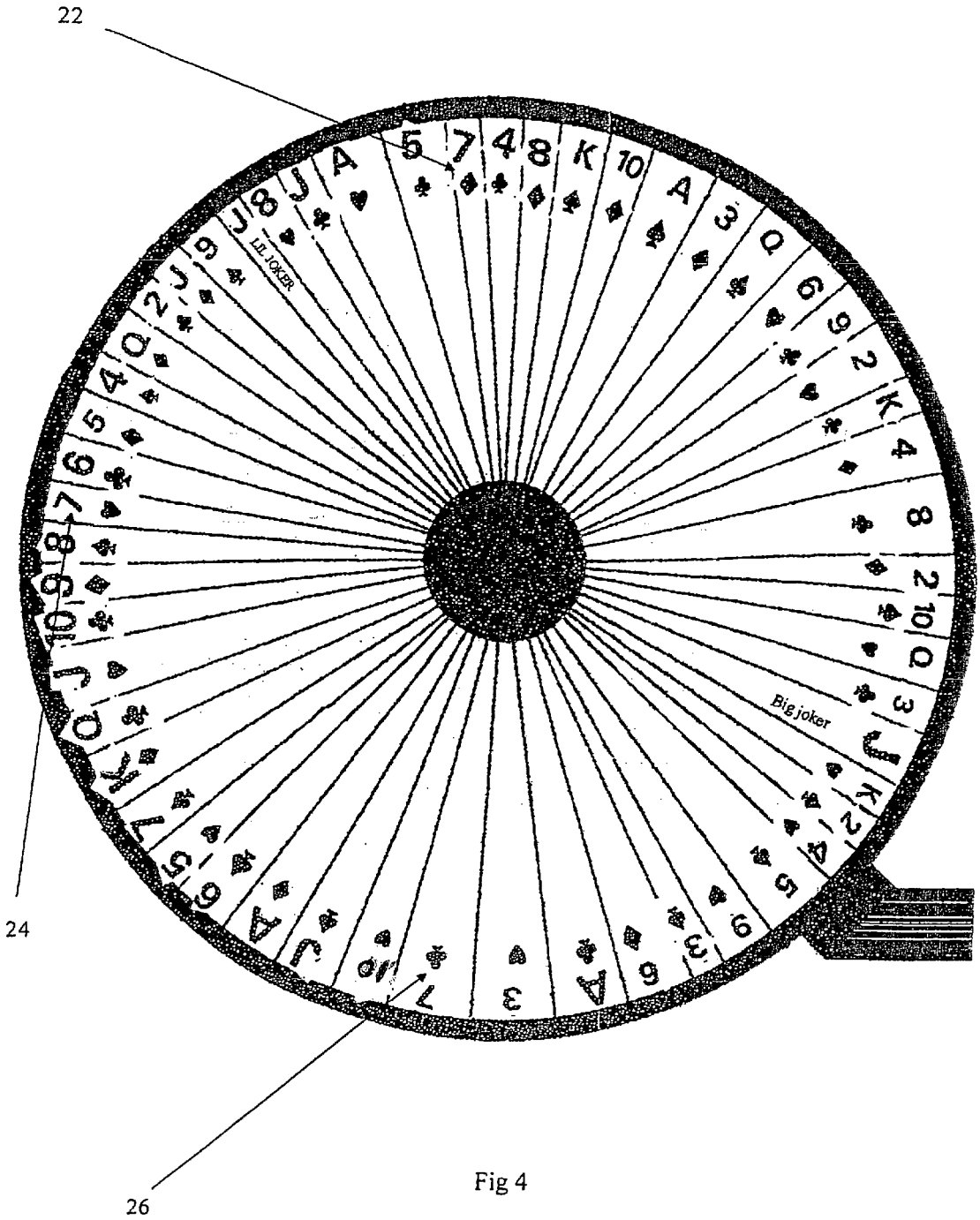
FIG. 4 is a perspective view of placement of the sevens.
Figure 5:
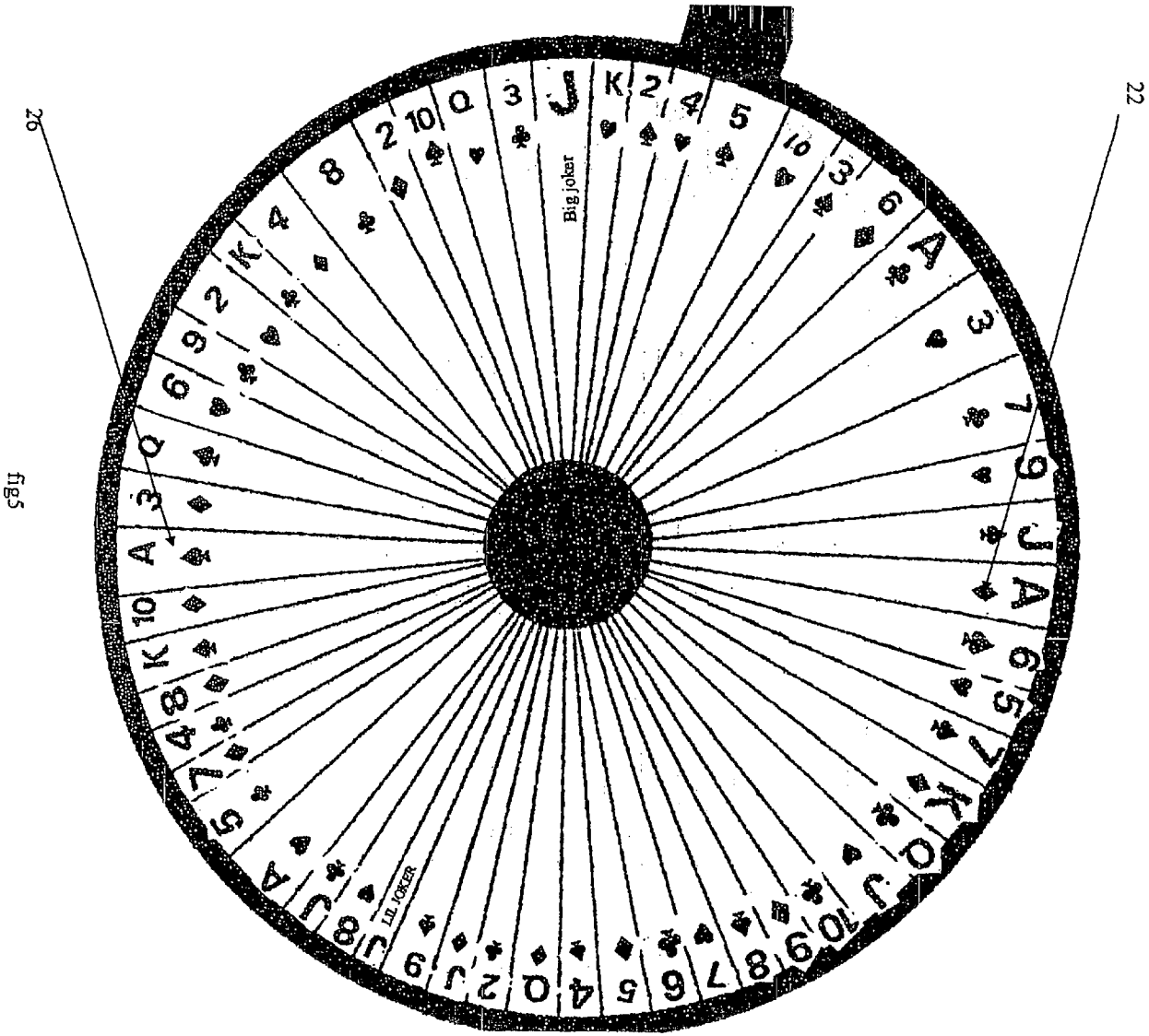
FIG. 5 is a view of a perspective placement of aces: only red ace as top card will create a pair of access
Figure 6:
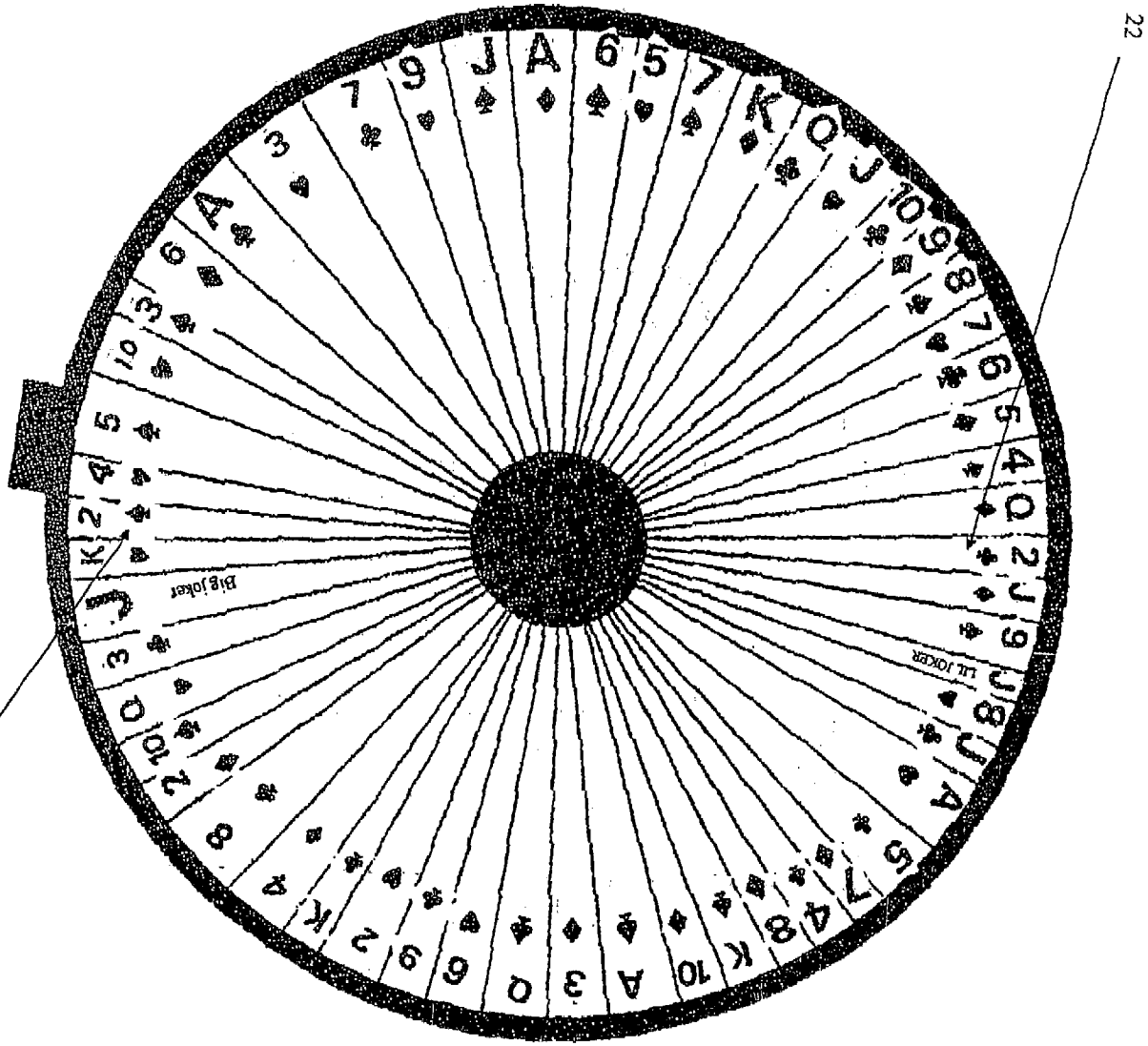
FIG. 6 is a perspective view of a placement of deuces: Only duce of clubs as top card will create a pair?
Figure 7:
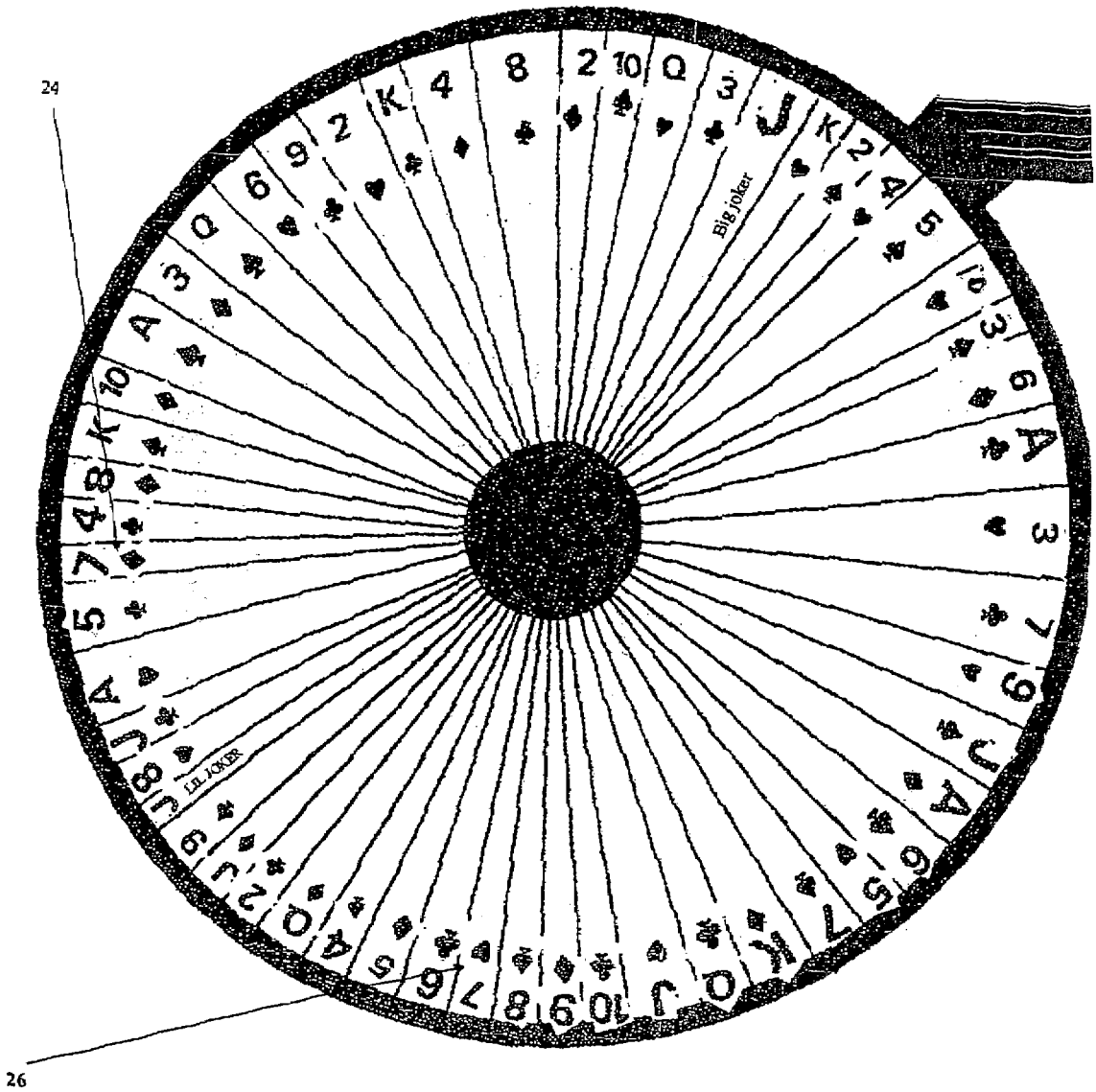
FIG. 7 is a perspective view of the pair of sevens: only happens when 7 of hearts is bottom card FIG. 8 a perspective view of a placement of the proper stated order of cards
Figure 8:
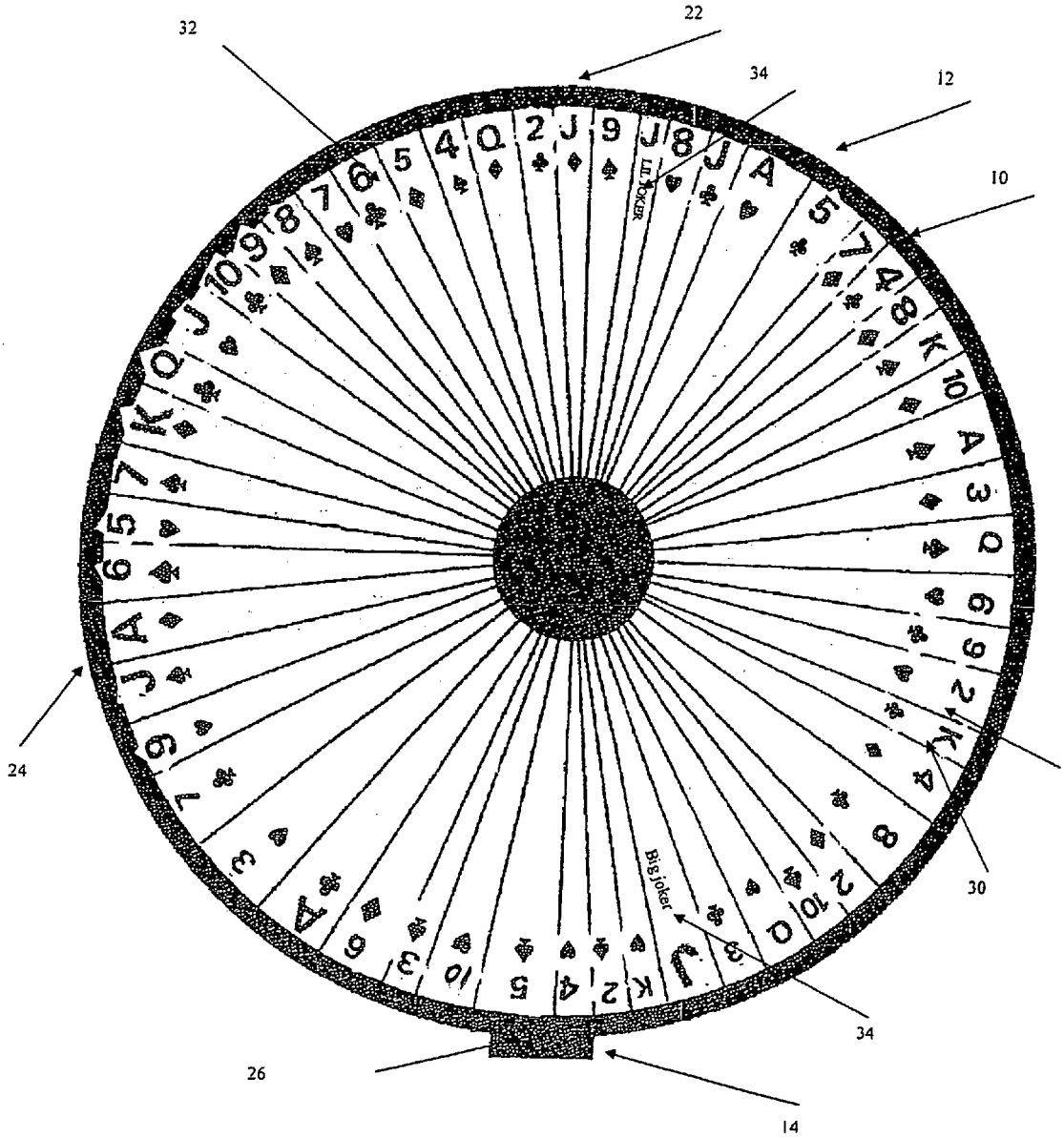
Figure 9:
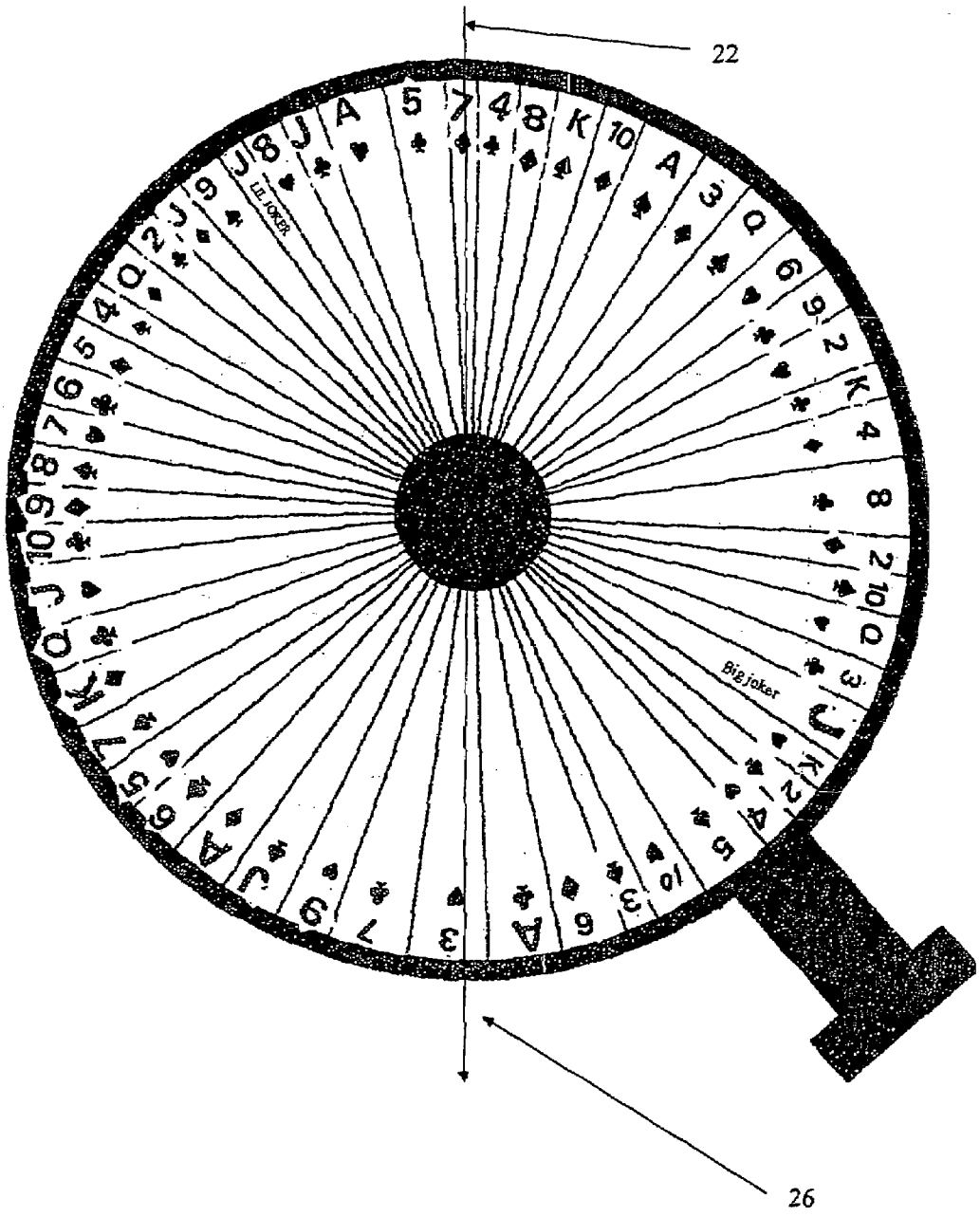
FIG. 9 is a perspective view of true center using the three sevens: line represents true center of wheel
Figure 10:
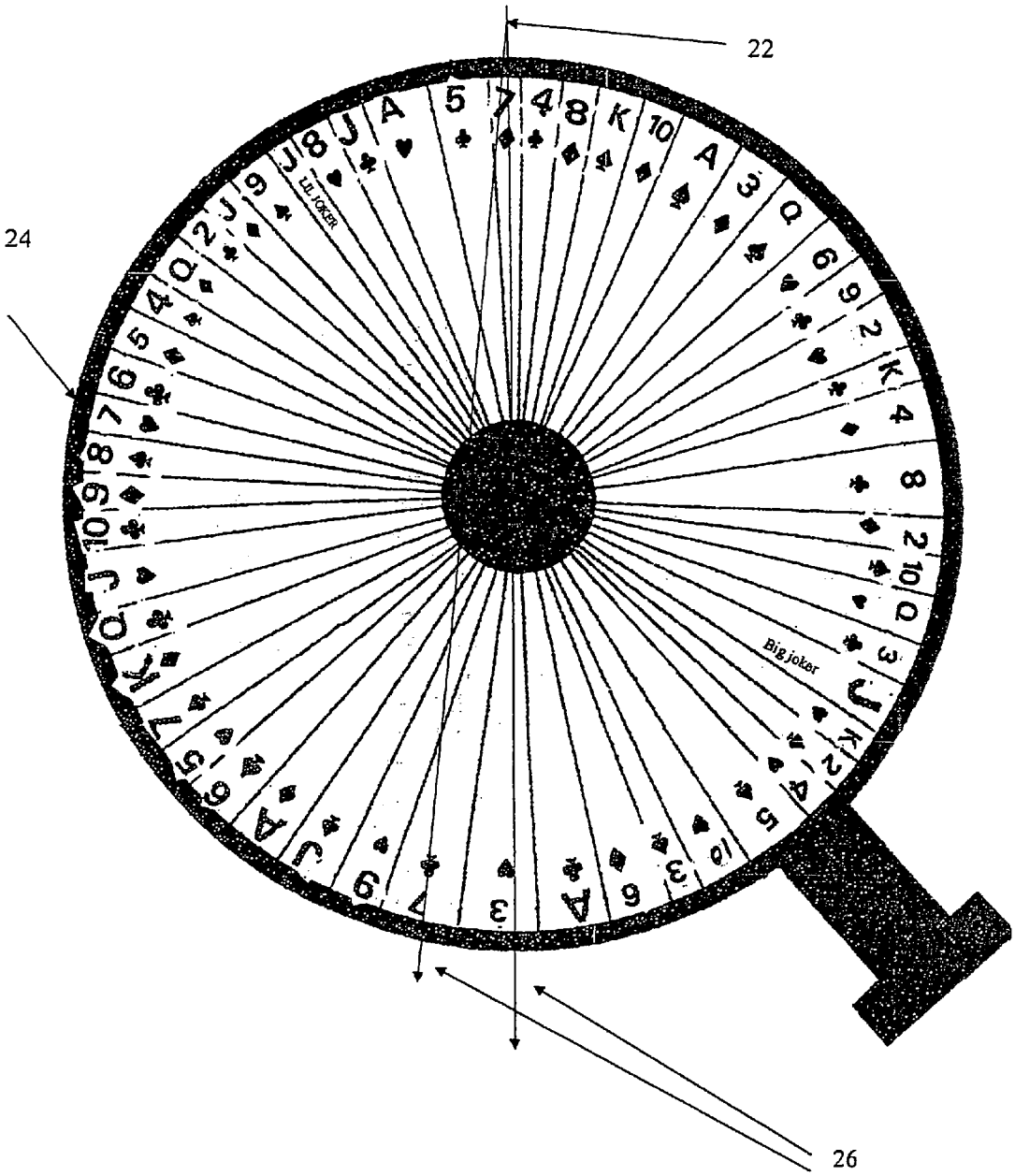
FIG. 10 is a perspective view of the game center using the three sevens on the wheel: The game center is achieved by moving the wheel one half the distance of a given space cards offsetting true center which was 28/28 is now 27/29 spaces.
Figure 11:
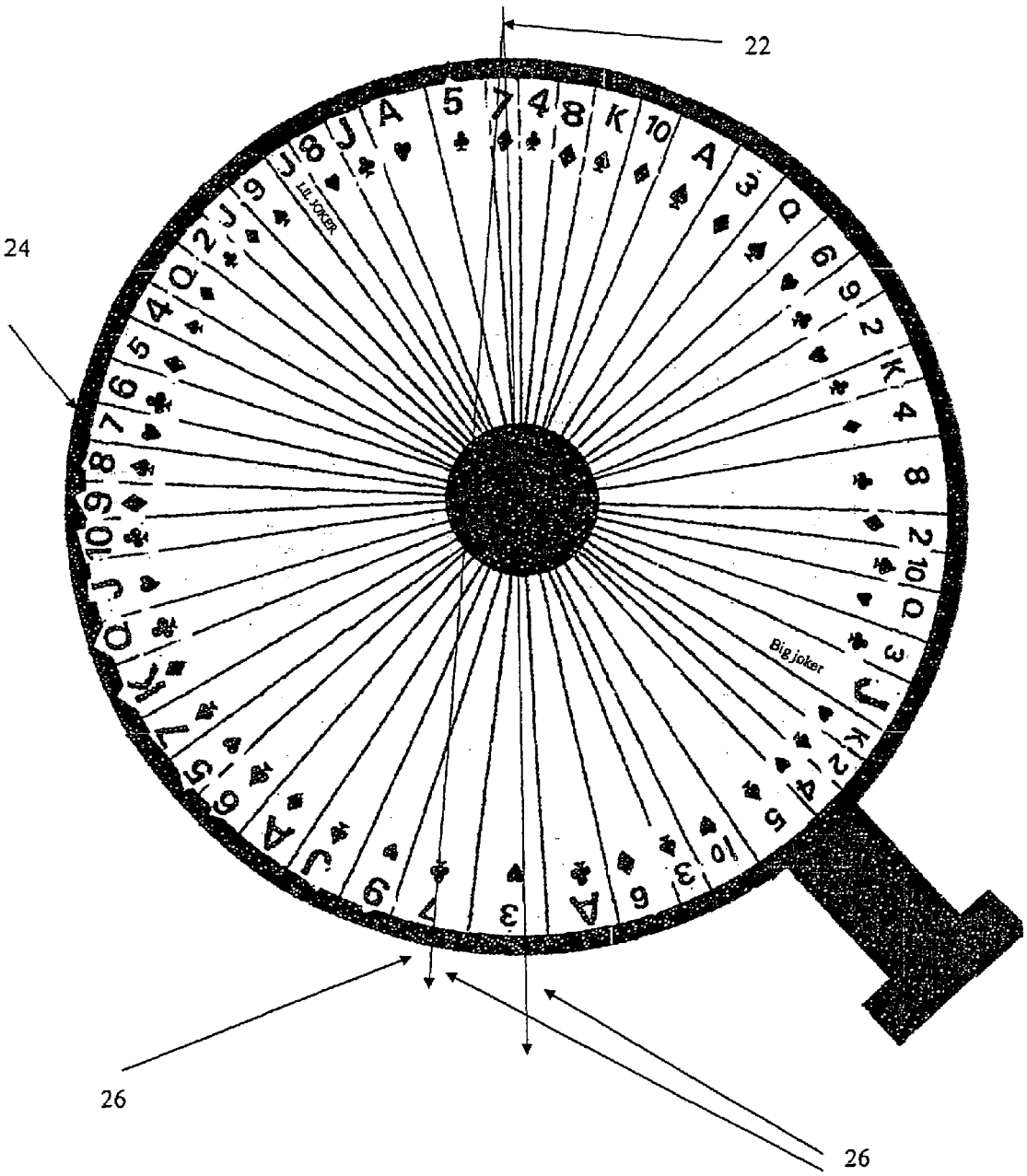
FIG. 11 is a perspective view of a game center using the three sevens and the bottom tang: tang goes from true center over one space creating new wheel center same as achieved by FIG. 11 just different way, reason for creating game center. (is to have the count from top tang to bottom tang going clockwise 29 spaces, but going counterclockwise 27 spaces). Which places dealers tang in the middle of top and bottom tang? Which can't be achieved with an even number 28/28?

The game apparatus illustrated in FIGS. 1, 2, and 3 can be used to play several games, with the preferred game being poker. The principle of the game apparatus is based on the worst hand of poker, in which the high card wins. In this game, the highest card is the joker playing card, followed by the ace, then the king, then the queen, etc. The playing of the game is derived from the nine hands of poker: straight flush, four of a kind, full house, flush, straight, three of a kind, two pair, one pair, and best card wins.

The first tang 22 located at the clock position of twelve o'clock of the rotating wheel 10 represents the top card. The second tang 24 located at the clock position of nine o'clock of the rotating wheel 10 represents the dealer's card. The third tang 26 located at the clock position of six o'clock of the rotating wheel 10 represents the bottom card. Ideally, the dealer (not shown) will be positioned at the side 42 of the main playing area 40 near the rotatable wheel 10 with the players (not shown) surrounding the remaining areas of the game board 28.

In general, the playing of the game apparatus occurs as follows. A chip, bill or coin is placed on one of the playing cards 36, 38, or other areas as described above, on the game board 28 to make a bet and the rotatable wheel 10 is spun by the dealer or a player. When the rotatable wheel 10 stops, the dealer determines a winner based on the bets made and the positioning of the tangs (e.g., 22, 24, 26).

One embodiment of playing the game apparatus is as follows. The playing card indicia 32, 34 that is present at the second tang 24 is used to determine whether the player that bets on a playing card indicia 36, 38 on the game board 28 wins bets to the top card (i.e., the playing card indicia 32, 34 stopped by the first tang 22) or the bottom card (i.e., the playing card indicia 32, 34 stopped by the third tang 26). For example, if the playing card indicia 32, 34 of the second tang 24 is the big Joker, the playing card indicia 32, 34 of the first tang 22 is the Ace of diamonds, and the playing card indicia 32, 34 of the third tang 26 is the Ace of spades. The possible winners would be:

1.) a bet on the game board 28 betting position of high pair 44*e;*

2.) a bet on the game board 28 betting position of any pair 44*g;*

3.) a bet on the game board 28 playing card indicia 32 of the Ace of diamonds;

4.) a bet on the game board 28 betting position of odd top 48*e* and odd bottom 48*i;*

5.) a bet on the game board 28 betting position of red top 48*g*; and

6.) a bet on the game board 28 betting position of diamonds.

There following is a representation of the possible bets that can be placed using the game apparatus. Other betting configurations are contemplated. This list is descriptive of the possible bets and is not to be considered limiting. Examples of bets include:

1.) Board Bet—a bet is placed on one of the playing card indicia 36, 38 of the game board 28;

2.) Split Bet—a bet is placed on the line between two playing card indicia 36, 38 of the game board 28;

3.) Street Bet—a bet is placed to cover three playing card indicia 36, 38 of the game board 28;

4.) Square Bet—a bet is placed to cover four playing card indicia 36, 38 of the game board 28;

5.) Section Bet—a bet is placed to cover a section 48*a*, 48*b*, 48*c*, 48*d* of six of the playing card indicia 36, 38 of the game board 28;

6.) Line Bet—a bet is placed to cover a column 46*f*, 46*g*, 46*h*, 46*i*, 46*j*, 46*k* of six of the playing card indicia 36, 38 of the game board 28;

7.) Double Line Bet—a bet is placed to cover a two columns 46*a*, 46*b*, 46*c*, 46*d*, 46*e* of six of the playing card indicia 36, 38 of the game board 28;

8.) Long Line Bet—a bet is placed to cover a line of nine of the playing card indicia 36, 38 of the game board 28;

9.) Double Long Line Bet—a bet is placed to cover a two lines of nine of the playing card indicia 36, 38 of the game board 28;

10.) Tri-Bet—a bet is placed on any three lines of six of the playing card indicia 36, 38 of the game board 28;

11.) Top Card Against the Dealer Bet—a bet is placed that the playing card indicia 36, 38 in the top card position (i.e., at tang 22) is higher than the playing card indicia 36, 38 in the dealer's card position (i.e., at tang 24);

12.) Bottom Card Against the Dealer Bet—a bet is placed that the playing card indicia 36, 38 in the bottom card position (i.e., at tang 26) is higher than the playing card indicia 36, 38 in the dealer's card position (i.e., at tang 24);

13.) Top Card Even Bet—a bet is placed that the playing card indicia 36, 38 in the top card position (i.e., at tang 22) is an even numbered playing card indicia 36, 38 (in the case the Joker appears, the bet stays or can be removed by the player);

14.) Bottom Card Even Bet—a bet is placed that the playing card indicia 36, 38 in the bottom card position (i.e., at tang 26) is an even numbered playing card indicia 36, 38 (in the case the Joker appears, the bet stays or can be removed by the player);

15.) Top Card Odd Bet—a bet is placed that the playing card indicia 36, 38 in the top card position (i.e., at tang 22) is an odd numbered playing card indicia 36, 38 (in the case the Joker appears, the bet stays or can be removed by the player);

16.) Bottom Card Odd Bet—a bet is placed that the playing card indicia 36, 38 in the bottom card position (i.e., at tang 26) is an odd numbered playing card indicia 36, 38 (in the case the Joker appears, the bet stays or can be removed by the player);

17.) Suit Bet—a bet is placed on one of the suit positions (i.e., hearts, spades, diamonds, clubs) of the game board 28;

18.) Three of a Kind Bet—a bet is placed that three of the same numbered playing card indicia 36 will be stopped by the tangs 22, 24, 26 (i.e., seven of hearts, seven of diamonds, and seven of spades);

19.) High Pair Bet—a bet is placed that a pair of high card 44*e* playing card indicia 36 will be stopped by two of the tangs 22, 26;

20.) Low Pair Bet—a bet is placed that a pair of low card 44*b* playing card indicia 36 will be stopped by two of the tangs 22, 26;

21.) Any Pair Bet—a bet is placed that any pair 44*g* of the playing card indicia 36 will be stopped by the tangs 22, 24, 26;

22.) Specific Bet—a bet is placed on betting positions as follows 7-7-7, A-A, 2-2, or 7-7 (44*a*, 44*b*, 44*c*, 44*d*) will be stopped by the tangs 22, 24, 26;

23.) Color Black Bet—a bet is placed that the playing card indicia 36, 38 in the top Card position (i.e.) (at tang 22 is black or green) the big joker is considered black or green) 46*h:*

24.) color bet a bet is placed at the playing card indicia 36, 38, on the bottom card position) (i.e.) at tang 26 is black or green the big joker considered black or green 48:

25.) color red bet-a bet is placed that the playing card indicia 36, 38 in the top card position (.e), at tang 22 is red or green (the little joker is considered red or green 26.) color red bet-a bet is placed that the playing card indicia 36, 38 in the bottom card position (i.e., at tang 26 is red or green (the little joker is considered red or green) 48*k*

Although the present invention is described herein as a game apparatus that is physically two separate playing areas, it is contemplated that the two separate playing areas can be combined into a single stand-alone device. It is also contemplated that the game apparatus can be utilized as an electronic game apparatus having push buttons to place bets and activate the wheel.

The present invention is a game apparatus that utilizes a rotatable wheel and a game board to play poker. The players make bets on the game board and the dealer spins the rotatable wheel. The advantage of this game apparatus is that one player can play against the dealer at the same time that a player can play the game of chance against the rotatable wheel. The game apparatus is easy to understand and allows lovers of roulette to expand their abilities to include elements of poker.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings without departing from the essential scope thereof. Therefore, it is Intended that the invention not be limited to the particular embodiment disclosed as the best mode contemplated for carrying out this invention.

The invention claimed is:

1. A game apparatus comprising:

a rotatable wheel having a display surface divided into fifty-four concentric areas, said areas having indicia of fifty-two standard playing cards and indicia of two joker playing cards thereon, said fifty-two standard play cards and two joker playing cards arranged in order based on a mathematical algorithm, the order including:

A♥; 5♣; 7♦; 4♣; 8♦; K♠; 10♦; A♠; 3♦; Q♠; 6♥; 9♣; 2♥; K♣; 4♦; 8♣; 2♦; 10♠; Q♥; 3♣; big joker; K♥; 2♠; 4♥; 5♠; 10♥; 3♠; 6♦; A♣; 3♥; 7♣; 9♥; J♠; A♦; 6♠; 5♥; 7♠; K♦; Q♣; J♥; 10♣; 9♦; 8♠; 7♥; 6♣; 5♦; 4♠; Q♦; 2♣; J♦; 9♠; little joker; 8♥; and J♣;

a plurality of stopping pegs disposed between each of the indicia of fifty-two standard playing cards and indicia of two joker playing cards;

a stationary wheel having at least three tangs attached thereto, said tangs positioned symmetrically apart about the stationary wheel, the symmetrically positioned tangs on the stationary wheel represent the cards on the rotatable wheel during playing of said game apparatus;

a means for attaching the rotatable wheel to the stationary wheel in a vertical configuration accommodating a rotation motion of said rotatable wheel, said rotation motion controlled by the physical interaction of said pegs of the rotatable wheel with said tangs of the stationary wheel; and, a horizontal playing surface in conjunction with said rotatable wheel, said horizontal playing surface having a main playing area divided into six columns of nine plots including indicia of fifty-two standard playing cards and indicia of two joker playing cards and a plurality of betting areas disposed on at least three borders of said main playing area.

2. The game apparatus of claim 1, wherein said indicia of standard playing cards are represented by two, three, four, five, six, seven, eight, nine, ten, jack, queen, king and ace each in a suit of hearts, spades, diamonds, and clubs.

3. The game apparatus of claim 1, wherein the means for attaching the rotatable wheel to the stationary wheel comprises:

a vertical support on which the stationary wheel is attached thereto; and a axle mounted to the rotatable wheel, said axle further attached to said stationary wheel permitting circular rotation of said rotatable wheel.

4. The tangs of game apparatus of claim 1, wherein one of said three tangs represents the random determination of said card when said rotatable wheel is rotated and stopped by the said pegs of said stationary wheel as if a roulette ball was used.

5. The tangs of game apparatus of claim 1, wherein the second of said three tangs represent a dealer's card randomly determined when said rotatable wheel is rotated and stopped by said pegs of the stationary wheel.

6. The tangs of game apparatus of claim 1, wherein the third of said three tangs represent said cards randomly determined when said rotatable wheel is rotated and stopped by said pegs of the stationary wheel, said third tang is incorporated for increasing odds and bets like achieving a hand of three sevens.

7. The game apparatus of claim 1, wherein said game apparatus is configured to be a single apparatus.

8. The game apparatus of claim 1, wherein said game apparatus is configured to be an electronic apparatus.

9. A method of playing a game apparatus comprising;

providing a rotatable wheel;

providing a horizontal playing surface;

placing a betting piece on said horizontal playing surface to make a bet, said horizontal playing surface comprising a main playing area divided into at least six columns of at least nine plots including indicia of fifty-two standard player cards and two joker playing cards thereon and a plurality of betting arrears disposed on at least three borders of said main playing area;

spinning said rotatable wheel in a circular rotation attached to an axle disposed in a stationary wheel having at least three tangs symmetrically positioned within the stationary wheel, said rotatable wheel having a display surface comprised of fifty-four concentric areas having indicia of fifty-two standard playing cards and two joker playing cards wherein said indicia of fifty-two standard playing cards and said indicia of two joker playing cards are positioned based on a mathematical algorithm on said rotatable wheel in an order including:

A♥; 5♠; 7♦; 4♣; 8♦; K♠; 10♦; A♠; 3♦; Q♠; 6♥; 9♣; 2♥; K♣; 4♦; 8♣; 2♦; 10♠; Q♥; 3♣; big joker; K♥; 2♠; 4♥; 5♠; 10♥; 3♠; 6♦; A♣; 3♥; 7♣; 9♥; J♠; A♦; 6♠; 5♥; 7♠; K♦; Q♣; J♥; 10♣; 9♦; 8♠; 7♥; 6♣; 5♦; 4♠; Q♦; 2♣; J♦; 9♠; little joker; 8♥; and J♣, said rotatable wheel having indicia thereon corresponding to said horizontal playing surface, said rotatable wheel having a plurality of stopping pegs disposed between each said concentric area;

determining a selection of cards from said indicia of fifty-two standard player cards and two jokers playing cards upon stopping the rotatable wheel by interaction of the said tangs and said stopping pegs and observing the positioning of the said tangs, wherein the tanks represent selected cards; and determining a winner of said bet by correspondence of said betting piece on said indicia of horizontal playing surface with position of said tangs on indicia of said rotatable wheel.

10. The method of claim 9, wherein said betting piece is at least one of a chip, a bill and a coin.

* * * * *